US009715823B2

(12) United States Patent
Aliakseyeu et al.

(10) Patent No.: US 9,715,823 B2
(45) Date of Patent: Jul. 25, 2017

(54) REMOTE CONTROL DEVICE

(71) Applicant: KONINKLIJKE PHILIPS N.V., Eindhoven (NL)

(72) Inventors: Dzmitry Viktorovich Aliakseyeu, Eindhoven (NL); Jonathan David Mason, Waalre (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/375,544

(22) PCT Filed: Feb. 20, 2013

(86) PCT No.: PCT/IB2013/051363
§ 371 (c)(1),
(2) Date: Jul. 30, 2014

(87) PCT Pub. No.: WO2013/124792
PCT Pub. Date: Aug. 29, 2013

(65) Prior Publication Data

US 2015/0015378 A1 Jan. 15, 2015

Related U.S. Application Data

(60) Provisional application No. 61/602,229, filed on Feb. 23, 2012.

(51) Int. Cl.
*G08C 17/02* (2006.01)
*G08C 17/00* (2006.01)

(52) U.S. Cl.
CPC ..... *G08C 17/02* (2013.01); *G08C 17/00* (2013.01); *G08C 2201/30* (2013.01);
(Continued)

(58) Field of Classification Search
CPC ..... G06F 1/3231; G06F 2200/1636; Y02B 60/1289; G08C 17/02; G08C 17/00
(Continued)

(56) References Cited

U.S. PATENT DOCUMENTS 7,777,649 B2 8/2010 De Ruyter et al.
7,782,297 B2 8/2010 Zalewski et al.
(Continued)

FOREIGN PATENT DOCUMENTS

JP 2009265897 A 11/2009
JP 2010277198 A 12/2010

OTHER PUBLICATIONS

Hinckley et al, "Sinsing Techniques for Mobile Interation", Symposium on User Interface Software and Technology, CHI Letters 2(2), 2000, pp. 91-100.

*Primary Examiner* — Yong Hang Jiang

(57) ABSTRACT

A remote control device (1) for remotely controlling an appliance (A) is provided. The remote control device (1) comprises a contact sensing facility (10), a control mode selection facility (20), an input facility (30), a processor facility (40) and a transmission facility (50). The contact sensing facility (10) determines a degree of physical contact between the remote control device and a user (U) and generates a mode control signal ($S_{mc}$) indicative for this degree. The control mode selection facility (20) selects one of a plurality of selectable operational modes (M1, M2, M3) of the remote control device dependent on the degree indicated by the mode control signal. The selectable operational modes enable respective subsets of user control modes from a plurality of user control modes. The input facility (30) is arranged to receive user input and generating a user input signal ($S_{inp}$) indicative for the user input. The processor facility (40) derives appliance control information ($S_{act}$) for the appliance from the user input signal according to a
(Continued)

function enabled by the selected operational mode and the transmission facility (50) transmits the appliance control information to the appliance.

16 Claims, 5 Drawing Sheets

(52) U.S. Cl.
CPC ..... *G08C 2201/31* (2013.01); *G08C 2201/32* (2013.01); *G08C 2201/91* (2013.01); *G08C 2201/93* (2013.01)

(58) Field of Classification Search
USPC ..... 340/12.22, 12.5
See application file for complete search history.

(56) References Cited

U.S. PATENT DOCUMENTS

| | | | | |
|---|---|---|---|---|
| 2008/0020803 | A1 | 1/2008 | Rios et al. | |
| 2009/0002217 | A1* | 1/2009 | Kryze ..... | G08C 17/02 341/176 |
| 2009/0102800 | A1 | 4/2009 | Keenan | |
| 2010/0121921 | A1 | 5/2010 | Dunton | |
| 2010/0138680 | A1 | 6/2010 | Brisebois et al. | |
| 2010/0300771 | A1 | 12/2010 | Miyazaki | |

* cited by examiner

REMOTE CONTROL DEVICE

CROSS-REFERENCE TO PRIOR APPLICATIONS

This application is the U.S. National Phase application under 35 U.S.C. §371 of International Application No. PCT/IB2013/051363, filed on Feb. 20, 2013, which claims the benefit of U.S. Provisional Application No. 61/602,229, filed on Feb. 23, 2012. These applications are hereby incorporated by reference herein.

FIELD OF THE INVENTION

The present invention relates to a remote control device.

The present invention further relates to a method for remotely controlling an appliance with a remote control device.

The present invention still further relates to a storage medium having stored thereon a computer program enabling a processor to carry out the method.

BACKGROUND OF THE INVENTION

Many consumer appliances, such as television or audio sets, allow some form of remote control by a remote control device. The user may provide control input, by pressing on a key board. U.S. Pat. No. 7,777,649 describes a handheld device that detects motion of the device itself, interpreting the motion as a command and executing or transferring the command.

SUMMARY OF THE INVENTION

It is an object of the invention to provide an improved remote control device.

It is a further object of the invention to provide an improved method for remotely controlling an appliance with a remote control device.

It is a still further object of the invention to provide a storage medium having stored thereon a computer program enabling a processor to carry out the improved method.

According to a first aspect of the invention a remote control device is provided for remotely controlling an appliance. The remote control device comprises

- a contact sensing facility for determining a degree of physical contact between the remote control device and a user and for generating a mode control signal indicative for this degree,
- a control mode selection facility for selecting one of a plurality of selectable operational modes of the remote control device dependent on the degree indicated by the mode control signal, said selectable operational modes enabling respective subsets of user control modes from a plurality of user control modes,
- an input facility for receiving user input and generating a user input signal indicative for said user input,
- a processor facility for deriving appliance control information for the appliance from the user input signal according to a function enabled by the selected operational mode,
- a transmission facility for transmitting said appliance control information to the appliance.

In the remote control device according to the first aspect of the invention various user control modes are available. Dependent on the degree of physical contact between the remote control device and a user a subset of the available user control modes is selected that is most suitable for remote control. Therewith it can be taken into account that user control modes are enabled that do not interfere with each other.

In an embodiment, said plurality of selectable operational modes comprise at least two of a first, a second and a third operational mode, wherein a first operational mode enables at least a first user control mode, wherein a second operational mode only enables a second user control mode, and wherein a third operational mode only enables a third user control mode, wherein in the first user control mode the user is enabled to control the appliance by providing visual input to the remote control device, wherein in the second user control mode the user is enabled to control the appliance by controlling a spatial state of the remote control device, wherein in the third user control mode the user is enabled to control the appliance by providing touch input to the remote control device.

Of the remote control device or accelerating the remote control device or by otherwise controlling a spatial state of the remote control device, wherein in the third user control mode the user is enabled to control the appliance by providing touch input to the remote control device.

A subset of user control modes is selected in each operational mode of the remote control device. A subset of user control modes in an operation mode may comprise more than one user control mode, provide that the user control modes in the subset do not interfere too much with each other. For example, a user control mode based on audio input may be used in the same operational mode as a user control mode based on visual input. However, it may be desired to have different operational modes for enabling a user control mode based on spatial state control of the remote control device and for a user control mode based on touch input.

Depending on the intended use and cost specifications the contact sensing facility may comprise one or more sensors for sensing a parameters indicative for the degree of contact between the remote control device and the user and for generating a corresponding sense signal. Sense signals from a plurality of these sensors may be combined by a logical or other function. In an embodiment said contact sensing facility is arranged to detect at least one of the following conditions, absence or presence of physical contact between the remote control device and the user, a direction of the remote control device with respect to a users face, a distance of the remote control device with respect to a users face a way in which the remote control device is held, an orientation in which the remote control device is held.

In an embodiment the contact sensing facility comprises at least a touch sensing facility for determining whether the device is held by a user, and for generating a grip indication signal indicative for this determination.

In an embodiment the contact sensing facility comprises at least a face recognition facility for determining whether the device is orientated towards a human face and for generating an orientation indication signal indicative for this determination.

In an embodiment the contact sensing facility comprises a distance sensor facility for determining a distance between the remote control device and the user, and for generating a distance indication signal indicative for this determination.

Depending on the user control modes that should be conditionally allowed for a particular application, the input facility in the remote control device according to the first aspect may comprise a selection of possible input sensors.

In an embodiment the input facility comprises a visual-input sensor and the remote control device has a first user control mode, in which first user control mode the remote control device is enabled to detect visual input by the user with the visual-input sensor and generate a visual-input signal, to derive appliance control information for the appliance from the visual-input signal according to a first function and to transmit said appliance control information to the appliance with said transmission facility.

In an embodiment the input facility comprises a spatial-state sensor and the remote control device has a second user control mode, in which second user control mode the spatial-state sensor is enabled to detect a spatial-state of the remote control device caused by the user, and generate a spatial-state signal as the user input signal, to derive appliance control information for the appliance from the user input signal according to a second function and to transmit said appliance control information to the appliance with said transmission facility. The spatial-state comprises the position and orientation of the remote control device, as well as their first and higher order temporal derivatives.

In an embodiment the input facility comprises a touch-input sensor and the remote control device has a third user control mode wherein the remote control device is enabled to accept user input from said touch-input sensor, to derive appliance control information for the appliance from said user input according to a third function and to transmit said appliance control information to the appliance with said transmission facility.

In an embodiment the input facility comprises an audio input sensor, and the remote control device has a fourth user control mode wherein the remote control device is enabled to accept user input from said audio input sensor, to derive appliance control information for the appliance from said user input according to a fourth function and to transmit said appliance control information to the appliance with said transmission facility.

According to a second aspect of the invention a method for remotely controlling an appliance with a remote control device is provided. The method comprises the steps of

- determining a degree of physical contact between the remote control device and a user and generating a mode control signal indicative for this degree,
- selecting one of a plurality of selectable operational modes dependent on the degree indicated by the mode control signal, said selectable operational mode enabling respective subsets of user control modes from a plurality of user control modes,
- deriving appliance control information from user input according to a function dependent on the enabled subset of user control modes,
- transmitting said appliance control information to the appliance.

According to a third aspect of the invention a storage medium is provided that has stored thereon a computer program enabling a processor to carry out the improved method according to the second aspect.

In the remote control device and method for remote controlling according to the invention the user input that is allowed and/or the way in which it is processed to obtain the appliance control information depends on the degree of physical contact between the remote control device and the user. Therewith the user has more options to control the appliance so that the remote control device and method for remote controlling are improved.

BRIEF DESCRIPTION OF THE DRAWINGS

These and other aspects are described in more detail with reference to the drawing. Therein.

DETAILED DESCRIPTION OF EMBODIMENTS

Like reference symbols in the various drawings indicate like elements unless otherwise indicated.

It will be understood that, although the terms first, second, third etc. may be used herein to describe various elements, components, steps and/or modes, these elements, components, steps, and/or modes should not be limited by these terms. These terms are only used to distinguish one element, component, step, and/or mode from another element, component, step, and/or mode. Thus, a first element, component, step, and/or mode discussed below could be termed a second element, component, step, and/or mode without departing from the teachings of the present invention.

Figure 1:
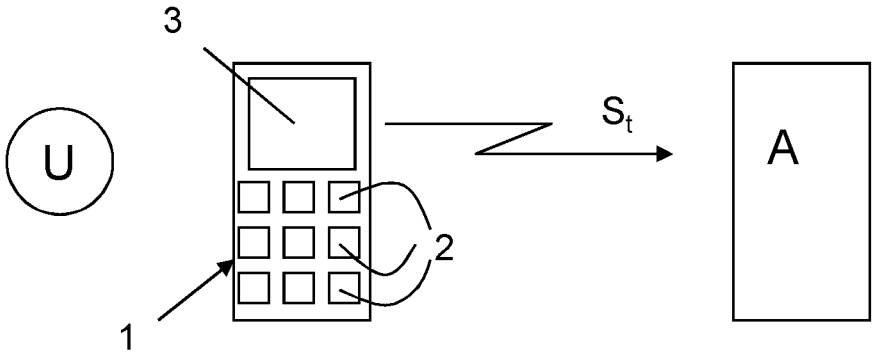
FIG. 1 shows a prior art remote control device.

FIG. 1 schematically shows a prior art remote control device 1 for remotely controlling an appliance A by a user U. The appliance is for example an audio or television set or a hard-disc recorder. The remote control device 1 comprises an input facility, such as buttons 2 to receive user input, a processing facility (not shown) for processing the user input and transmission means (not shown) for transmitting control signals St to the appliance A to activate or control functionalities of the appliance A in accordance with the user input.

Figure 2:
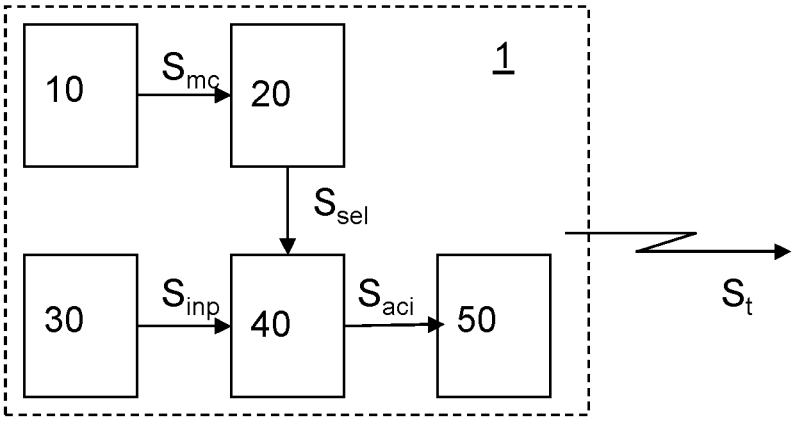
FIG. 2 shows a first embodiment of a remote control device according to the first aspect of the invention.

FIG. 2 shows a first embodiment of a remote control device 1 according to the first aspect of the invention for remotely controlling an appliance A. The remote control device 1 comprises a contact sensing facility 10 for determining a degree of physical contact between the remote control device and a user U. The contact sensing facility 10 generates a mode control signal $S_{mc}$ indicative for this degree. The remote control device 1 further comprises a control mode selection facility 20 for selecting one of a plurality of selectable operational modes of the remote control device dependent on the degree of contact indicated by the mode control signal. Each of the selectable operational modes enables respective subsets of user control modes from a plurality of user control modes.

The remote control device 1 further comprises an input facility 30 for receiving user input and generating a user input signal $S_{inp}$ indicative for said user input. The remote control device 1 still further comprises a processor facility 40 for deriving appliance control information for the appliance from the user input signal according to a function enabled by the selected operational mode. The remote control device 1 still further comprises a transmission facility 50 for transmitting said appliance control information $S_{aci}$ to the appliance A.

Figure 3:
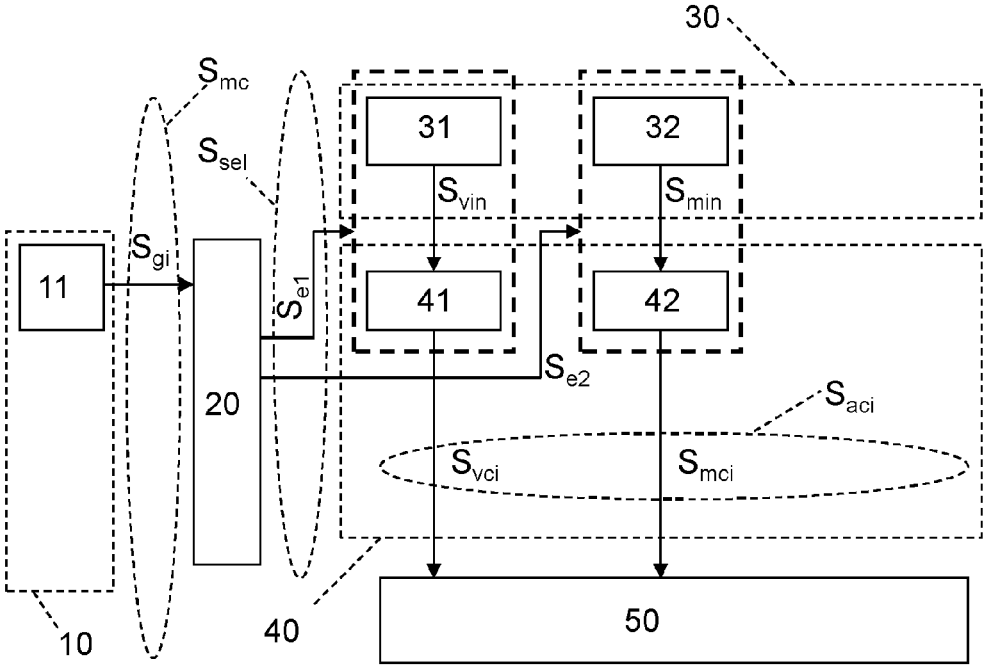
FIG. 3 shows a second embodiment of a remote control device according to the first aspect of the invention.

FIG. 3 shows a second embodiment of a remote control device according to the first aspect in more detail. The input facility 30 comprises a visual-input sensor 31 and the processing facility 40 comprises a visual-input processing functionality 42 for processing user input signals $S_{vin}$ generated by the visual-input sensor. The remote control device has a first user control mode UI1 wherein the remote control device is enabled to detect visual input provided by the user, such as gestures with the visual-input sensor to derive appliance control information for the appliance from the user input signal according to a first function and to transmit said appliance control information to the appliance with said transmission facility. The visual-input sensor 31 comprises for example a few visual-input sense elements, such as photodetectors that enable the visual-input processing functionality 42 to determine whether a surface of the remote control device is in the shadow of the users hand and/or whether the shadow moves in a certain direction and with what speed. In accordance therewith, the visual-input processing functionality 42 derives appliance control information $S_{aci}$ here visual-input control information $S_{vci}$ for the appliance from the user input signal $S_{vin}$ provided by the photo detector. For example movement of the shadow in a first direction of the remote control device may result in a control signal that causes an appliance A to change a first setting, e.g. a channel selection of a television set. Movement of the shadow in a second direction of the remote control device may result in a control signal that causes an appliance A to change a second setting, e.g. a sound volume of the television set. In another embodiment the visual-input sensor 31 is for example a camera. In combination with a more advanced visual-input processing functionality 42 this allows recognition of more different and specific types of visual user inputs, such as facial expressions.

The input facility 30 of the remote control device shown in FIG. 3 also comprises a spatial-state sensor 32. The spatial-state sensor 32 is arranged to detect (changes in) a spatial state of the remote control device and to provide user input signals $S_{min}$ indicative thereof. The remote control device 1 has a second user control mode U2 wherein the spatial-state sensor is used to detect (changes in) a spatial state of the remote control device controlled by the user. Typically, the spatial-state sensor 32 comprises one or more acceleration sensors. However, also other types of spatial-state sensors are available, such as jerk sensors, which sense a third derivative of position. Also tilt sensors may be used to provide an output signal indicative for an orientation o the remote control device. The processing facility 40 comprises a spatial-state signal processing functionality 42 to process spatial-state sensor input signals. In accordance therewith, the spatial-state signal processing functionality 42 derives appliance control information $S_{aci}$ here spatial state control information $S_{mci}$ for the appliance from the user input signal $S_{min}$. For example accelerating the remote control device in a first direction may result in a control signal $S_{mci}$ that causes an appliance A to change a first setting and accelerating the remote control device in a second direction may result in a control signal $S_{mci}$ that causes an appliance A to change a second setting. The first and second setting are for example channel and sound volume of a television set or an audio set.

In the embodiment shown in FIG. 3, the contact sensing facility 10 comprises a touch sensing facility 11 for determining whether the device is held by a user, and for generating a grip indication signal $S_{gi}$ indicative for this determination. Dependent on the grip indication signal $S_{gi}$ the control mode selection facility 20 selects one of a plurality of selectable operational modes of the remote control device.

In this case the control mode selection facility selects a first operational mode M1 if the grip indication signal $S_{gi}$ indicates that the remote control device is not held by the user. The touch sensing facility 11 comprises for example pressure sensitive elements that sense a pressure exerted on mutually opposing sides of the remote control device. These pressure sensitive elements may be formed by pressure sensitive bevels. These may be used both to detect if the remote control device is in the user's hand(s), and if so, How the user holds the remote control device. In that case the touch sensing facility 11 may indicate that the remote control is handheld if the sensed pressure exceeds a threshold value. The touch sensing facility 11 may alternatively include a touch sensor array that is capable of detecting a pressure pattern. In that case the touch sensing facility 11 may indicate that the remote control is handheld if the detected pattern resembles that of a hand. In again another embodiment the touch sensing facility 11 comprises a temperature sensor. The touch sensing facility 11 may indicate that the remote control is handheld if the sensed temperature is a predetermined level higher than room temperature.

The remote control device according to the first aspect has a plurality of user control modes. In the embodiment shown in FIG. 3 the remote control device has first user control mode UC1 wherein visual input provided by the user is used for remote control and a second user control mode UC2, wherein spatial-state information of the remote control device is used for remote control.

Dependent on the value of the mode control signal $S_{mc}$, here the grip indication signal $S_{gi}$ provided touch sensing facility 11, the control mode selection facility 20 selects one of a plurality of selectable operational modes M1, M2. Each of the selectable operational modes M1, M2 enables a respective subset of user control modes from plurality of user control modes UC1, UC2. The first operational mode M1 is selected by the control mode selection facility 20 if the indication signal $S_{gi}$ indicates that the remote control device is not handheld. In that case the device enables both the first and the second user control mode. Although the first user control mode UC1 is not used in that situation it does not disturb operation of the remote control device. I.e. the subset of available user control modes in this case corresponds to the plurality of user control modes. Alternatively, the second user control mode UC2 may be disabled in mode M1. However it is advantageous to keep this user control mode available to allow the user to immediately apply motion control, when he/she takes up the remote control device.

If the indication signal $S_{gi}$ indicates that the remote control device is handheld, the control mode selection facility 20 selects the operational mode M2. In this case the second user control mode UC2 is (kept) enabled and the first user control mode UC1 is disabled. Accordingly the subset of available user control modes comprises the second user control mode UC2. The first user control mode UC1 is disabled, so as to prevent that motion used to provide control signals also results in generation of undesired control signals resulting from collateral visual-input.

In particular the control mode selection facility 20 enables selection from a plurality of user control modes, by enable signals $S_{e1}$, $S_{e2}$ that respectively enable the first user control mode and the second user control mode. The enable signals may be used in various ways to enable selection. For example, enable signals $S_{e1}$, $S_{e2}$ may selectively enable a sensor, e.g. 31 or 32, a processing facility, e.g. 41 or 42, or both, e.g. 31 and 41 or 32 and 42.

Figure 4:
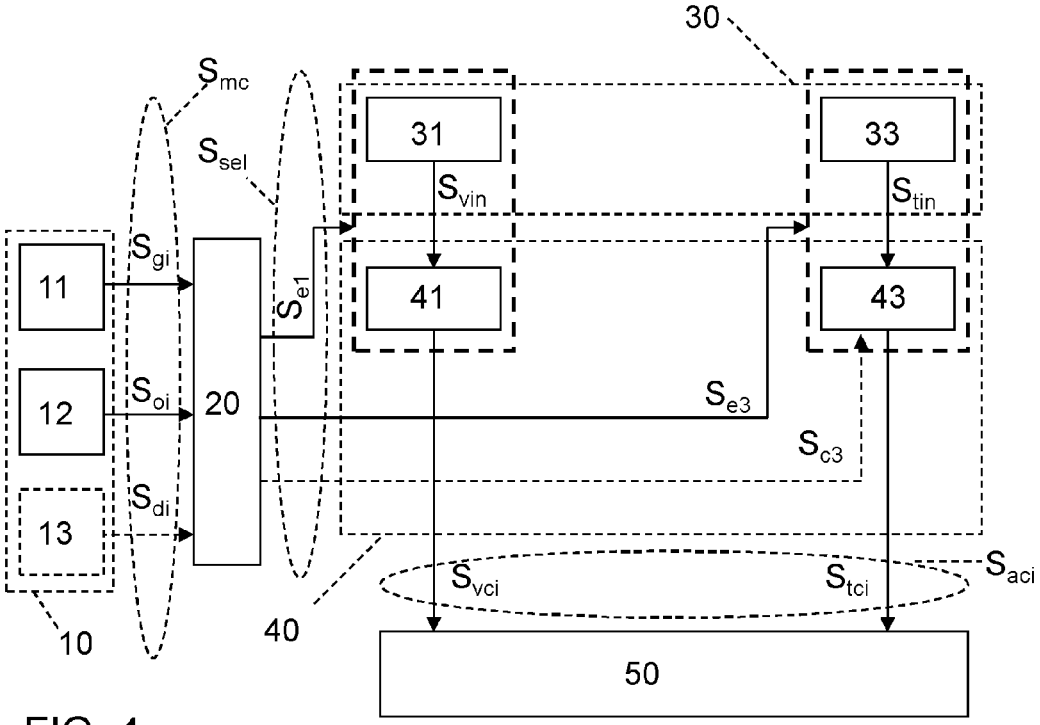
FIG. 4 shows a third embodiment of a remote control device according to the first aspect of the invention.

FIG. 4 shows a third embodiment of a remote control device according to the first aspect in more detail. The third embodiment differs from the second embodiment in that a touch-input facility 33 is provided. Touch-input is defined here as any input for remote control provided by touching a surface of the remote control device regardless whether a pressure is exerted therewith to said surface or not. Accordingly, a touch-input facility comprises for example a set of one or more keys, a touch panel (possibly integrated in a display), separate touch sensitive elements, etc. In a third user control mode UC3 the user is enabled to remotely control the appliance A by providing user input to the touch-input facility 33. In that case the touch-input processing functionality 43 derives appliance control information Stci from the input signals $S_{tin}$ provided by the touch-input facility 33. This third embodiment allows a first user control mode UC1, using the visual-input sensor 31 and the associated processing facility 41 and/or a third user control mode UC3 using the touch or pressure sensor 33 and the associated processing facility 43.

In this third embodiment the remote control device may assume one of operational modes M1 and M3. The first operational mode M1 is selected by the control mode selection facility 20 if the indication signal $S_{gi}$ indicates that the remote control device is not handheld. In that case the mode selection facility 20 enables both the first and the third user control mode. Although the third user control mode (UC3) is not used in that situation it does not disturb operation of the remote control device. I.e. the subset of available user control modes in this case corresponds to the plurality of user control modes UC1, UC3. Alternatively, the third user control mode UC3 may be disabled in mode M1. However it is advantageous to keep this user control mode UC3 available to allow the user to immediately apply touch control. The user may for example activate a simple device function by tapping on the remote control device when the latter is laid down on a table. This may for example be used to switch an appliance on/off.

If the indication signal $S_{gi}$ indicates that the remote control device is handheld, the control mode selection facility 20 selects the operational mode M3. In this case the third user control mode UC3 is (kept) enabled and the first user control mode UC1 is disabled. Accordingly the subset of available user control modes comprises the third user control mode UC3. The first user control mode UC1 is disabled in this operational mode M3, as in practice, while providing touch input signals the user may involuntary introduce visual effects, e.g. by moving in front of the remote control device, or by moving the remote control device itself. In case the first user control mode UC1 was still enabled in the operational mode M3 this could result in collateral and possibly undesired appliance control signals $S_{vci}$.

In a variation of the third embodiment, the contact sensing facility 10 comprises at least a face recognition facility 12 for determining whether the device is orientated towards a human face and for generating an orientation indication signal $S_{oi}$, indicative for this determination. In this variation the contact sensing facility 10 also comprises a distance sensor facility 13 for determining a distance between the remote control device and the user, and for generating a distance indication signal $S_{di}$ indicative for this determination.

These extensions 12, 13 of the contact sensing facility allow for a refinement of the third user control mode. The mode control facility 20 provides a control signal $S_{c3}$ that depends on a distance between the remote control device 1 and the face of a user U.

The control signal $S_{c3}$ controls the operation of the touch-input signal processing facility 43, dependent on a value indicted by this control signal. In case the touch-input facility 33 is a touch pad for example, the control signal $S_{c3}$ may have the effect that for small distances, the movements over the touch pad are relatively strongly amplified, whereas for large distances, the movements over the touch pad are relatively weakly amplified. In this way it can be taken into account that the user can point at the touchpad with a precision that is relatively high if the remote control is relatively close and less precise when the remote control is at a larger distance. If the remote control device is provided with a display, the control signal $S_{c3}$ may also be used to provide information on the display with a size that is approximately proportionally to the distance.

Figure 5:
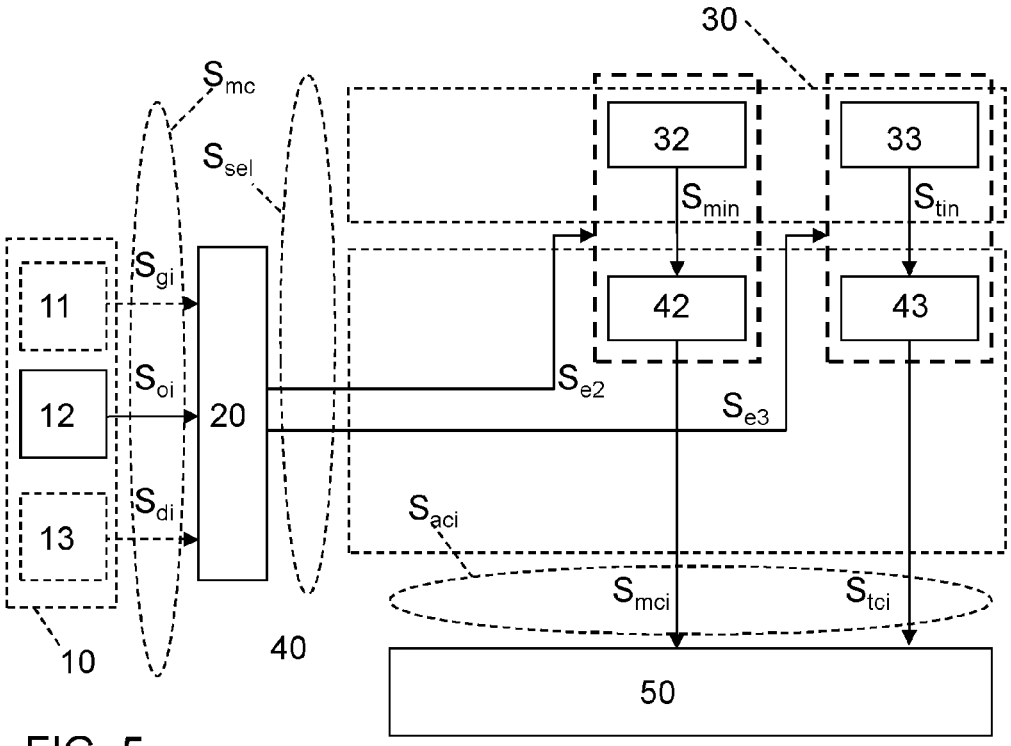
FIG. 5 shows a fourth embodiment of a remote control device according to the first aspect of the invention.

FIG. 5 shows a fourth embodiment of a remote control device according to the first aspect in more detail. In this embodiment the remote control device comprises a spatial-state sensor 32 and associated processing facility 42, as described for the second embodiment with reference to FIG. 3. In this embodiment the remote control device further comprises a touch-input facility 33 and associated processing facility 43, as described for the third embodiment with reference to FIG. 4. The contact sensing facility 10 comprises a face recognition facility 12 for determining whether the device is orientated towards a human face and for generating an orientation indication signal $S_{oi}$ indicative for this determination. In this fourth embodiment the contact sensing facility 10 does not comprise a touch sensing facility (11) for determining whether the device is held by a user as was described for the embodiments of FIGS. 3 and 4. Neither does the contact sensing facility 10 include a distance sensor facility (13) in this embodiment, although these facilities 11, 13 may optionally be included, as indicated by dashed lines.

The input facilities available in this fourth embodiment enable a second and a third user control mode UC2, UC3. The remote control device has a second operational mode M2, wherein only the second user control mode UC2 is enabled wherein the user provides input by setting/changing a spatial state of the remote control device, and a third operational mode M3, wherein only the third user control mode UC3 is enabled wherein the user provides touch input.

The control mode selection facility 20 selects one of these operational modes M2, M3 dependent on the degree indicated by the mode control signal, in this case the orientation indication signal $S_{oi}$ provided by face recognition facility 12. If the orientation indication signal $S_{oi}$ indicates that a side of the remote control device provided with the touch input facility faces the user, then the third operational mode M3 is selected, so that the user can provide touch input. However, in that third operational mode M3 the user is prevented from remotely controlling the appliance by setting/changing a spatial state of the remote control device, to prevent that entering touch input inadvertently results in appliance control signals generated by the spatial-state sensing facility 32 and associated facility 42. Alternatively, if the orientation indication signal $S_{oi}$ indicates that a side of the remote control device provided with the touch input facility does not face the user, then the second operational mode M2 is selected, enabling the second user control mode UC2, so that the user can provide input for remote control by setting/changing a spatial state of the remote control device, e.g. accelerating or tilting the device. Processing of touch input signals according to the third user control mode UC3 is inhibited to prevent that holding the remote control device inadvertently results in appliance control signals generated by the touch input control part 33, 43.

In a more economic embodiment, the contact sensing facility 10 may comprise a tilt sensing facility instead of a face recognition facility 12 to provide the orientation indication signal. However, for the purpose of selecting between motion and touch input, a face recognition facility may operate more reliably. In an embodiment a tilt sensing facility and a face recognition facility may be combined to generate a mode control signal.

A tilt sensing facility may also be used as an alternative, or in addition to the motion sensing facility. The tilt sensing facility in that case would allow the user to provide input by varying an orientation of the remote control device. In an embodiment a tilt sensing facility could be used both as a facility for providing a mode control signal and as a facility for providing a user input signal. In another embodiment, the contact sensing facility 10 may comprise a touch sensing facility 11 that is arranged to provide a grip indication signal $S_{gi}$ indicative for the way the user holds the remote control device. For example, the remote control device may have a back side and a front side, wherein the latter is provided with a keyboard with keys 33 for controlling functions of the appliance. In that case, if the touch sensing facility 11 senses that the back side is substantially covered by the users hand, the grip indication signal $S_{gi}$ serves as a mode control signal that selects the third operational mode M3, allowing only the subset UC3 wherein only remote control by input with the keyboard is enabled. However, if the touch sensing facility 11 senses that the front side is substantially covered by the users hand, the grip indication signal $S_{gi}$ serves as a mode control signal that selects the second operational mode M2 wherein only remote control according to the second user control mode UC2 is enabled, e.g. wherein remote control is possible by changing an orientation or an acceleration of the remote control device.

Figure 6:
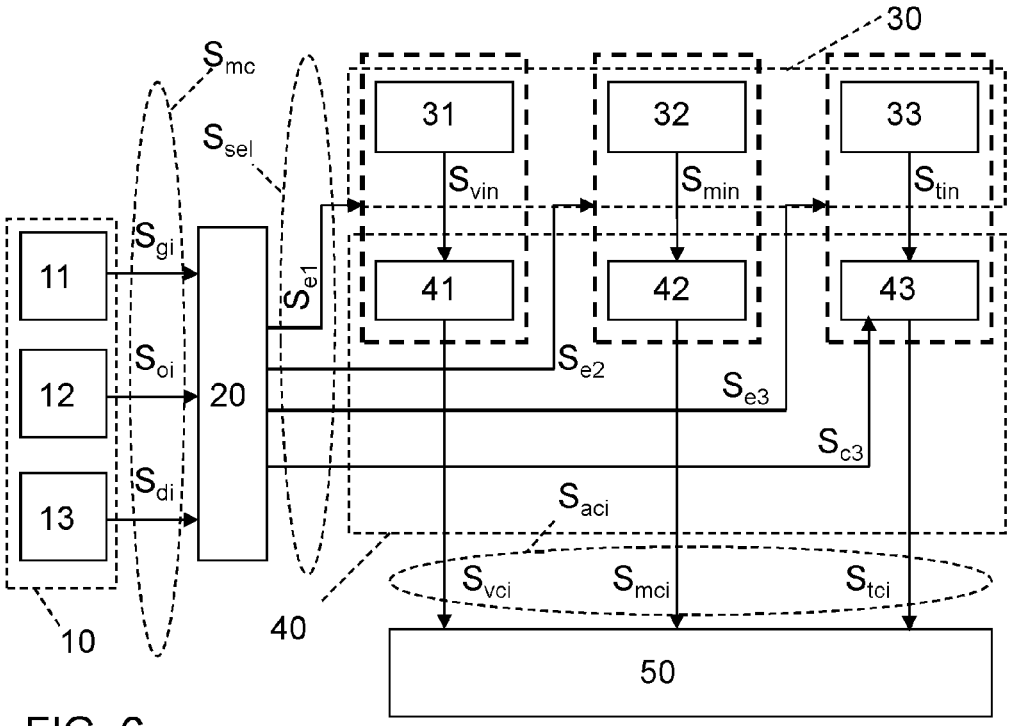
FIG. 6 shows a fifth embodiment of a remote control device according to the first aspect of the invention.

FIG. 6 shows a fifth embodiment of a remote control device according to the first aspect in more detail. In this fifth embodiment remote control device comprises a contact sensing facility 10 with a touch sensing facility 11, a face recognition facility 12 and a distance sensor facility 13. The input facility 30 comprises a visual-input facility 31, such as a camera, with associated processing facility 41, a spatial-state sensing facility 32, such as a motion or tilt sensor with associated processing facility 42 and a touch-input facility 33, such as a touch-panel with associated processing facility 43. The input facility 30 therewith allows for a first, a second and a third user control mode UC1, UC2, UC3. In the first user control mode visual user input, e.g. gestures and facial expressions are used for remote control of the appliance A. In the second user control mode UC2 the user provides input for remote control by setting and/or changing a spatial state of the remote control device, e.g. by holding the remote control device in different angles or moving the remote control device. In the third user control mode UC3 the user may provide input for remote control by touching a touch panel or pressing buttons. In this case the remote control device has a first, a second and a third operational mode M1, M2 and M3, each allowing a selection of the potentially possible user control modes UC1, UC2, UC3.

The control mode selection facility 20 is arranged to select one of the plurality of selectable operational modes M1, M2, M3 according to the conditions indicated in the following Table 1.

TABLE 1

| Selectable operational modes | |
|---|---|
| Condition | operational mode |
| device not hold by user | M1 |
| device hold by user and not facing user | M2 |
| device hold by user and facing user | M3 |

If the remote control device is not hold by a user, for example when it is laid down on a table, control mode selection facility 20 selects mode M1 as the operational mode. If the user holds the remote control device, the control mode selection facility 20 selects the second operational mode M2 if the remote control device does not face the user. If the user holds the remote control device and the remote control device faces the user, the control mode selection facility 20 selects the third operational mode M3.

An overview of allowed user control modes in each of the operational modes M1, M2, M3 is indicated in the following Table 2.

TABLE 2

| Allowed user control modes<br>Allowed user control modes | | | |
|---|---|---|---|
| operational mode | Visual (UC1) | movement/tilt (UC2) | touch/press (UC3) |
| M1 | Yes | (Yes) | (Yes) |
| M2 | No | Yes | No |
| M3 | No | No | Yes |

It can be seen that in this embodiment, the first user control mode UC1 is only enabled in the first operational mode M1. The second user control mode is enabled in the second operational mode M2, and optionally enabled in the first operational mode M1, but always disabled in the third operational mode M3. The third user control mode UC3 is enabled in the third operational mode M3, and optionally enabled in the first operational mode M1, but always disabled in the second operational mode M2.

Figure 7:
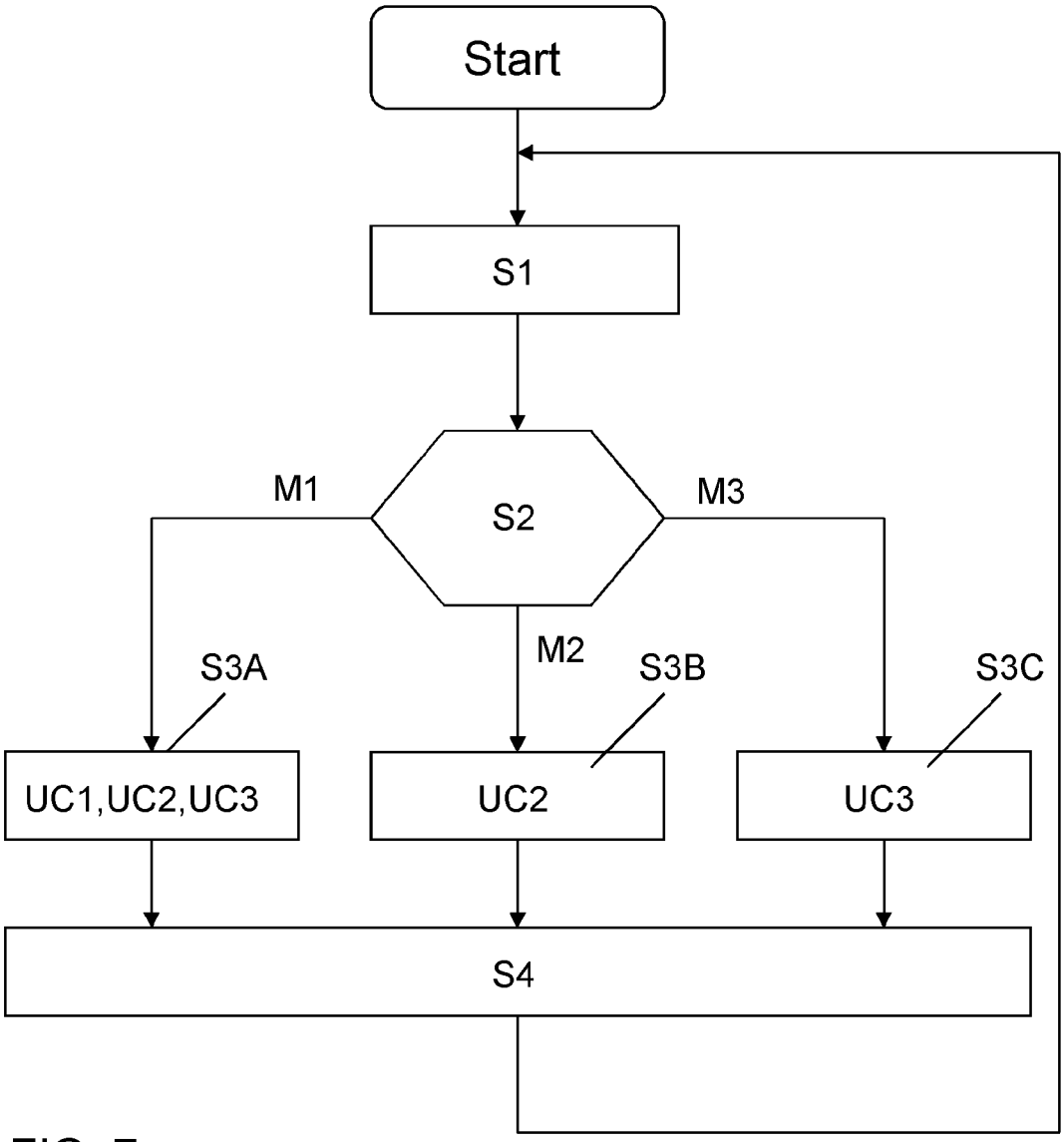
FIG. 7 shows an embodiment of a method according to the second aspect of the invention, FIG. 8 schematically shows how different user control modes are associated with different interaction ranges.

FIG. 7 illustrates a method for remotely controlling an appliance with a remote control device. The method comprises a first step S1, of determining a degree of physical contact between the remote control device and a user and generating a mode control signal indicative for this degree. In a second step S2 one of a plurality of selectable operational modes is selected dependent on the degree indicated by the mode control signal. In this case the operational modes M1, M2 and M3 are selectable. Each of these operational modes enables respective subsets of user control modes from a plurality of user control modes, for example as illustrated in Table 2 above. In other embodiments also other operational modes may be selectable, for example an operational mode wherein the remote control device is insensitive to user input. In an embodiment such an operational mode may be activated automatically after a period of non-activity for energy saving purposes.

In a third step S3A, S3B, S3C appliance control information ($S_{aci}$) is derived from user input according to a function dependent on the enabled subset of user control modes. Here, in case mode M1 is selected the third step is S3A, wherein appliance control information ($S_{aci}$) is derived from each of vision user input, motion user input and touch user input.

In a fourth step S4 the appliance control information so obtained is transmitted to the appliance.

In FIG. 7, the exemplary method according to the second aspect is illustrated as a sequential procedure to clearly indicate the various aspects involved therein and their mutual relations. Although this is a possible implementation, this is in practice not necessary. Various steps may be carried out in parallel. For example, while generating (S1) a mode control signal indicative for the degree of physical contact between the remote control device and a user at time t, an operational mode may be selected (S2) on the basis of this mode control signal for time t-Δt1. Simultaneously, the device may derive (S3) appliance control information ($S_{aci}$) from user input according to a function dependent on the subset of user control modes that was enabled by the operational mode selection S2 at t-Δt1-Δt2. At the same time appliance control information derived in step S3 at time t-Δt1-Δt2-Δt3 may be transmitted (S4) to the appliance.

Alternatively, some of these steps may be carried out in parallel, for example in case a hardware functionality is time shared. For example, a single general purpose processor may be used to carry out various processing step.

In summary the present invention provides amongst others a remote control device 1 for remotely controlling an appliance A. The remote control device 1 comprises a contact sensing facility 10, a control mode selection facility 20, an input facility 30, a processor facility 40 and a transmission facility 50. The contact sensing facility 10 determines a degree of physical contact between the remote control device and a user U and generates a mode control signal $S_{mc}$ indicative for this degree. The control mode selection facility 20 selects one of a plurality of selectable operational modes M1, M2, M3 of the remote control device dependent on the degree indicated by the mode control signal. The selectable operational modes enable respective subsets of user control modes from a plurality of user control modes. The input facility 30 is arranged to receive user input and generating a user input signal $S_{inp}$ indicative for the user input. The processor facility 40 derives appliance control information $S_{aci}$ for the appliance from the user input signal according to a function enabled by the selected operational mode and the transmission facility 50 transmits the appliance control information to the appliance.

Figure 8:
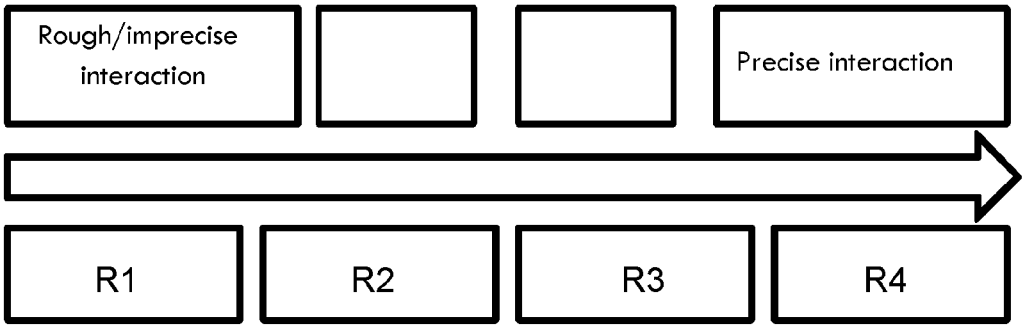

In FIG. 8 the direction of the arrow indicates an increasing proximity between the user and the remote control device. The boxes below the arrow schematically show typical ranges corresponding to a particular degree of physical contact between the remote control device and the user. In range R1, the remote control device is within arm length of the user. In range R2, the remote control device is loosely held by the user. In range R3 the remote control device is more firmly held by the user. In range R4 the remote control device is firmly held by the user and observed by the user. The boxes above the arrow schematically indicate the enabled user control modes. In range R1 typically course user control modes are enabled, while in range R4 typically precise user control modes are enabled.

The user needs to start the remote control device or application to enable the control. Alternatively the device or application can start automatically in a vicinity of the TV using short range wireless communication. Once the application has been activated the user can place the remote control device near himself/herself or hold it in their hand. If the remote control device is placed near the user, range one interactions become available. In the range one, only basic functions are available (2-3 functions). Because only a limited number of controls are supported very simple interaction techniques can be used, such as swiping/flicking gestures for changing channel, continuous circular movements for continuous channel change (zapping), dragging movement up and down to control volume, and single tap for mute. Of course this is only one possible set of interaction settings. If the user keeps hold of the remote control in their hand, using relaxed grip (range R2), similar controls are available (e.g. gestures can be performed with the other hand), however since the user already holds the remote control in the hand, basic TV functions can be mapped to different interactions that use an accelerometer and other sensors embedded in the remote control: slightly turning the remote control to the left or right will change a channel, turning the remote control forward and backward change the volume, shaking the remote control will mute (or alternately select a random channel).

Finally if the user holds the remote control using a control grip (i.e. higher pressure on the sides of the remote control and screen directed toward person face) the full functionality becomes available through a standard touch interface. If enabled, the zooming feature (i.e. moving the remote control closer to the face) can be used to change the information provided on a display of the remote control (or alternatively on the TV screen) i.e. if the remote control is held further away the channel overview is provided, if remote control is moved closer, it zooms into one channel and if even closer it zooms onto a particular show.

Figure 9:
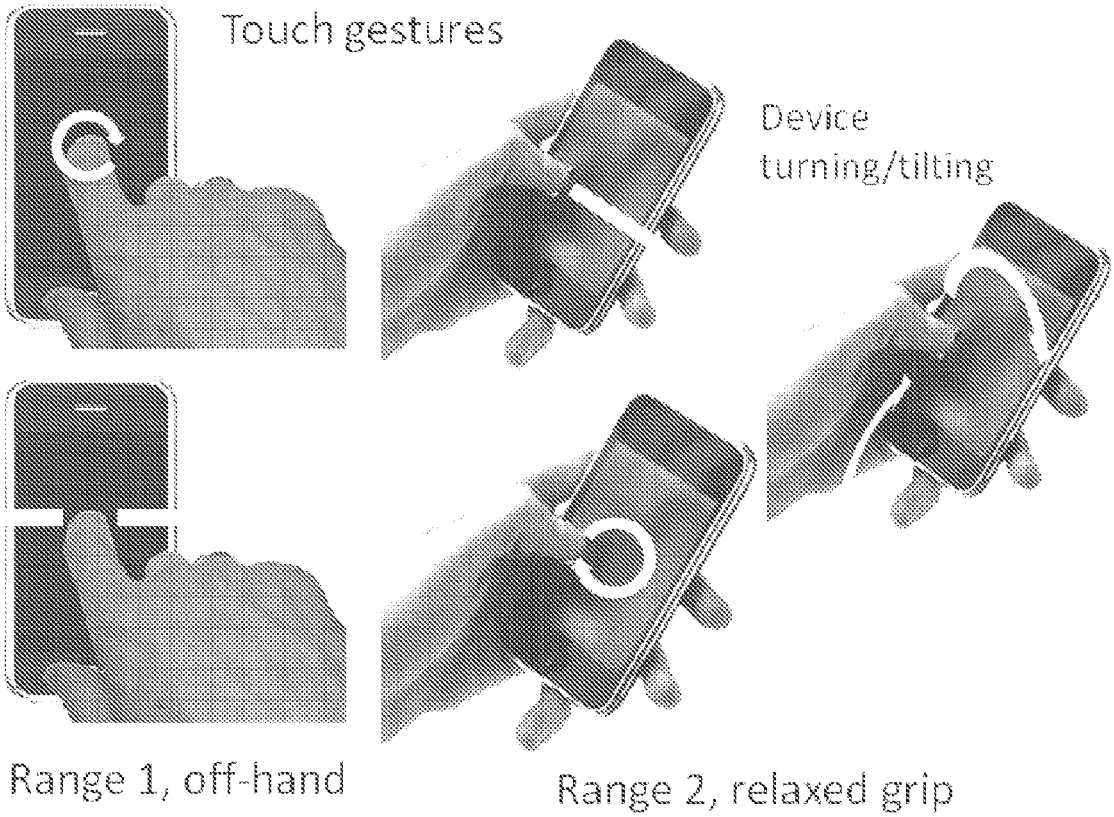
FIG. 9 shows examples of user control operations in various user control modes.

FIG. 9 shows some examples of possible user control operations to be used in various user control modes for remote control of a television set. The top part of the left side of FIG. 9 shows how a first gesture is used in the first user control mode to initiate a channel zapping mode, wherein the television set automatically cycles through the available channels and the bottom part shows how a second gesture is used to control the television set to select the next channel or the previous channel. In both cases the users finger moves in front of the remote control device, without touching the device. The middle two figures show how the same gestures are used again in the third user control mode, now by touching the remote control device. The right part of FIG. 9 shows how further user control options are enabled by the second user control mode. In this example by the user provides user control by rotating or tilting the remote control device.

The approach to have different operational modes assigned to use ranges of interaction described above, can also be applied for controlling other appliances such as audio players or even lighting applications. The main difference is the mapping between the particular interaction and a function it controls, for example instead of mute, a single tap on the screen can pause the play, the shake instead of random channel can used to down rank the song, turning remote control slightly to the left or right can change the song, while turning on a higher angle can change albums, etc.

Although embodiments of the present invention have been illustrated in the accompanying drawings and described in the foregoing detailed description, it will be understood that the invention is not limited to the embodiments disclosed, but is capable of numerous modifications without departing from the scope of the invention as set out in the following claims. For example, in case the remote control device is manufactured as a flexible device, a shape-state of the device may be determined and used to generate a shape-state signal. This input facility would enable a user control mode UC4, wherein the user can remotely control an appliance by controlling the shape-state of the remote control device. A user control mode UC3 based on touch input is typically part of another operational mode than the user control mode UC4 based on shape-state input, so that these user control modes UC3, UC4 cannot interfere with each other. By way of a further example, the remote control device may be provided with a audio-input sensor, for example in combination with a suitable processing facility arranged to recognize voice comments. The device may have different user control modes UC5A, UC5B, UC5C, . . . each for recognizing voice commands. Depending on the proximity of the remote control device and its orientation towards the user a different user control mode may be selected to take into account the expected signal/noise ratio. If the signal/noise ratio is expected to be high, a user control mode is selected that enables recognition of a control command from a relatively large set of control commands. If the signal/noise ratio is expected to be low, a user control mode is selected that only enables recognition of a control command from a relatively small set of control commands, e.g. only the commands on/off.

The remote control device may be a stand-alone device, but may alternatively be part of another device or being installed as an additional functionality on another device, such as a smart phone. The remote control application can be downloaded from an app store for example. Additional functions can also be applied to make use of the connection between the television and the remote control application. For example, the app may be installed on a smart phone and have a detection functionality to detect that the smart phone is being called. Upon this detection or on detection that the call is accepted the app may provide manual or automatic means to pause the television program or mute the sound (or put on the subtitles during the call). The interaction via the app could also be used to mine data on viewing preferences e.g. which programs did people just skip past; which did they pause on; which did they watch; which did they find more information on etc. This could all be useful data for television program providers obtainable partially via the interaction between the user and the app.

It is noted that appliances to be controlled by the remote control device need not be limited to audio-visual appliances, but may be any remotely controllable appliances. For example, various household devices could be remotely controlled with a remote control device and method for remote control according to the present invention. A user noticing that something is boiling over on a cooking hob, may rapidly cause a lowering of the heat by shaking the remote control device, e.g. integrated in a smart phone. While if a more precise control is required, the user may look at the remote control device to enable more precise remote control options. Likewise a remote control device and method according to the invention may be used to control other appliances, e.g. a lighting installation, or a sprinkle installation.

A 'facility', as will be apparent to a person skilled in the art, is meant to include any hardware (such as separate or integrated circuits or electronic elements) or software (such as programs or parts of programs) which reproduce in operation or are designed to reproduce a specified function, be it solely or in conjunction with other functions, be it in isolation or in co-operation with other elements. The invention can be implemented by means of hardware comprising several distinct elements, and by means of a suitably programmed computer. In device claims enumerating several facilities, several of these facilities can be embodied by one and the same item of hardware. 'Computer program product' is to be understood to mean any software product stored on a computer-readable medium, such as a floppy disk, downloadable via a network, such as the Internet, or marketable in any other manner.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). Also, use of the "a" or "an" are employed to describe elements and components of the invention. This is done merely for convenience and to give a general sense of the invention. This description should be read to include one or at least one and the singular also includes the plural unless it is obvious that it is meant otherwise.

The invention claimed is:

1. A remote control device for remotely controlling an appliance in one of a plurality of selectable operational modes dependent upon a degree of physical contact between the remote control device and a user, the remote control device comprising:

an input facility configured to receive user input and generate a user input signal indicative of the user input, a contact sensing facility configured to determine the degree of physical contact between the remote control device and a user, and generate a mode control signal indicative of the determined degree of physical contact, a control mode selection facility configured to receive the mode control signal from the contact sensing facility, and select one of the plurality of selectable operational modes of the remote control device dependent on the determined degree of physical contact between the remote control device and the user as indicated by the mode control signal, an input facility configured to receive user input and generate a user input signal indicative of the user input, a processor facility configured to derive appliance control information for the appliance from the user input signal according to a function enabled by the selected operational mode, a transmission facility configured to transmit said appliance control information to the appliance, wherein the respective selections of the operational mode enables respective corresponding subsets of user control modes from a plurality of user control modes, wherein in a first operational mode, there is no physical contact between the device and the user and the corresponding subset of user control modes includes a visual control mode, a movement/tilt control mode and a touch/press control mode.

2. The remote control device according to claim 1, wherein the contact sensing facility is configured to detect at least one condition selected from the group consisting of:

an absence or presence of physical contact between the remote control device and the user, a direction of the remote control device with respect to a user's face, a distance of the remote control device with respect to a user's face a way in which the remote control device is held, an orientation in which the remote control device is held.

3. The remote control device according to claim 1, wherein said contact sensing facility comprises a touch sensing facility configured to determine whether the device is held by a user, and further configured to generate a grip indication signal indicative of the determination.

4. The remote control device according to claim 1, wherein said contact sensing facility comprises a face recognition facility configured to determine whether the device is orientated towards a human face and further configured to generate an orientation indication signal indicative of the determination.

5. The remote control device according to claim 1, wherein said contact sensing facility comprises a distance sensor facility configured to determine a distance between the remote control device and the user, and further configured to generate a distance indication signal indicative of the determination.

6. The remote control device according to claim 1, wherein the input facility comprises a visual-input sensor and wherein a first user control mode enables the device to:

detect a visual input by the user via the visual-input sensor, generate a visual-input signal, to derive appliance control information for the appliance from the visual-input signal according to a first function, and transmit the derived appliance control information to the appliance via a transmission facility.

7. The remote control device according to claim 1, wherein the input facility comprises a spatial-state sensor and wherein in a second user control mode the spatial-state sensor is enabled to:

detect a spatial-state of the remote control device effected by the user, and generate a spatial-state signal as the user input signal, to derive appliance control information for the appliance from the user input signal according to a second function.

8. The remote control device according to claim 1, wherein said input facility comprises a touch-input sensor and wherein in a third user control mode the remote control device is enabled to:

accept user input from said touch-input sensor, to derive appliance control information for the appliance from said user input according to a third function, and transmit said appliance control information to the appliance via a transmission facility.

9. The remote control device according to claim 1, wherein said input facility comprises an audio input sensor, and having a fourth user control mode wherein the remote control device is enabled to accept user input from said audio input sensor, to derive appliance control information for the appliance from said user input according to a fourth function and to transmit said appliance control information to the appliance via a transmission facility.

10. A method of remotely controlling an appliance from a remote control device, the method comprising:

determining, by a contact sensing facility, a degree of physical contact between the remote control device and a user, generating, by the contact sensing facility, a mode control signal indicative of the determined degree of physical contact, selecting, by a control mode selection facility, one of a plurality of selectable operational modes dependent on the degree of physical contact as indicated by the mode control signal, wherein the respective selections of the selectable operational mode enables respective corresponding subsets of user control modes from a plurality of user control modes, deriving, by the control mode selection facility, appliance control information from user input according to a function dependent on the enabled subset of user control modes in the selected operational mode, and transmitting the appliance control information to the appliance, wherein in a first operational mode, there is no physical contact between the device and the user and the corresponding subset of user control modes includes a visual control mode, a movement/tilt control mode and a touch/press control mode.

11. The method according to claim 10, wherein said plurality of selectable operational modes comprises a third operational mode that enables at least a first user control mode, wherein in said first user control mode the user is enabled to control the appliance by providing visual input to the remote control device.

12. The method according to claim 10 wherein the step of determining a degree of physical contact comprises a detection of at least one condition selected from the group consisting of:

one of an absence or presence of physical contact between the remote control device and the user, a direction of the remote control device with respect to a user's face, a distance of the remote control device with respect to a user's face a way in which the remote control device is held, an orientation in which the remote control device is held.

13. The method according to claim 10, wherein said plurality of selectable operational modes comprises at least a first operational mode that enables at least a first user control mode, wherein the first user control mode enables the user to visually control the appliance by providing a visual input to the remote control device.

14. The method according to claim 10, wherein determining a degree of physical contact between the remote control device and a user includes determining mutually different degrees of presence of physical contact.

15. The method according to claim 10, wherein the plurality of selectable operational modes further comprises at least a second operational mode and a third operational mode, wherein upon determining a degree of physical contact between the user and the remote control device, setting one of the second or third operational modes dependent on the determined degree of physical contact, wherein the second operational mode enables a second user control mode enabling the user to control the appliance by controlling a spatial state of the remote control device, and wherein the third operational mode enables a third user control mode enabling the user to control the appliance by providing touch input to the remote control device.

16. A non-transitory computer-readable storage-medium that is not a transitory propagating signal or wave, having stored thereon instructions that when executed cause processing circuitry to:

determine, by a contact sensing facility, a degree of physical contact between the remote control device and a user, generate, by the contact sensing facility, a mode control signal indicative of the determined degree of physical contact, select, by a control mode selection facility, one of a plurality of selectable operational modes dependent on the degree of physical contact as indicated by the mode control signal, wherein the respective selections of the selectable operational mode enables respective corresponding subsets of user control modes from a plurality of user control modes, derive, by the control mode selection facility, appliance control information from user input according to a function dependent on the enabled subset of user control modes in the selected operational mode, and transmit the appliance control information to the appliance wherein the respective selections of the operational mode enables respective corresponding subsets of user control modes from a plurality of user control modes, and wherein in a first operational mode, there is no physical contact between the device and the user and the corresponding subset of user control modes includes a visual control mode, a movement/tilt control mode and a touch/press control mode.

* * * * *